US005878896A

United States Patent [19]

Eudier et al.

[11] Patent Number: 5,878,896

[45] Date of Patent: Mar. 9, 1999

[54] METHOD FOR CONTROLLING THE SWINGING OF A HANGING LOAD AND DEVICE FOR THE IMPLEMENTATION OF THE METHOD

[75] Inventors: Jean-Yves Eudier, Montivilliers; Vincent DeMoustier, Le Havre, both of France

[73] Assignee: Caillard, Le Havre, France

[21] Appl. No.: 596,293

[22] PCT Filed: Aug. 12, 1994

[86] PCT No.: PCT/FR94/01005

§ 371 Date: Feb. 13, 1996

§ 102(e) Date: Feb. 13, 1996

[87] PCT Pub. No.: WO95/05336

PCT Pub. Date: Feb. 23, 1995

[30] Foreign Application Priority Data

Aug. 13, 1993 [FR] France ..... 93 09973

[51] Int. Cl.[6] ..... B66C 13/06

[52] U.S. Cl. ..... 212/270; 212/275

[58] Field of Search ..... 212/275, 270

[56] References Cited

U.S. PATENT DOCUMENTS 5,117,992 6/1992 Simkus, Jr. et al. .

5,127,533 7/1992 Virkkunen ..... 212/275

5,219,420 6/1993 Kiiski et al. ..... 212/275

5,550,733 8/1996 Yun et al. ..... 212/275

FOREIGN PATENT DOCUMENTS 0 394 147 10/1990 European Pat. Off. .

42 38 795 7/1993 Germany .

OTHER PUBLICATIONS

E. Ohnishi et al., "Automatic Control of an Overhead Crane", Control Science and Technology for the Progress of Society, Aug. 1981, vol. 4, pp. 1885–1890.

*Primary Examiner*—Thomas J. Brahan

*Attorney, Agent, or Firm*—Young & Thompson

[57] ABSTRACT

Method and device for controlling the swinging motion of an oscillating load suspended from a movable support, wherein the movement of the support is controlled by a speed setpoint. The method includes a step (AS1) for automatically controlling the actual swaying value of the oscillating load by means of a zero swaying value and a step (37) for adjusting the speed setpoint (CV) of the support according to a correction value (E1) determined during the automatic swaying control step (AS1). The invention can be used, for example, for moving a load by means of a harbour crane.

13 Claims, 4 Drawing Sheets

METHOD FOR CONTROLLING THE SWINGING OF A HANGING LOAD AND DEVICE FOR THE IMPLEMENTATION OF THE METHOD

The present invention relates to a method for controlling the swinging of a hanging load.

It also relates to a device for the implementation of this method.

In the field of the handling and lifting of loads, especially for moving containers using cranes or container gantries, it is very important to move the loads accurately from one point to another, and more particularly to obtain no swinging of the load at the end of its path.

A load, such as a container, suspended using cables from a mobile support consisting, for example, of a motorized trolley designed to move horizontally along the rails of a gantry, forms a pendulum which is generally subjected to a great amount of swinging owing to the high operating speeds which may reach 3 meters per second, and the great length of the lifting cables, lying between 10 and 40 meters.

In reality, there is some damping brought about by the friction of the cables on the pulleys, the elastic deformation of the cables, friction from the surrounding air, etc.

However, this is not sufficient to completely damp out the oscillatory motion of the load and obtain no swinging of the latter at the end of its trajectory.

Patent FR 90-09145 discloses a method for controlling the movement of a hanging load, in which method the actual position of the hanging load is slaved to a theoretical position, the latter satisfying a theoretical law which gives no swinging of the load at the end of its journey.

This method consequently implies that the movement of the mobile support also has to follow a theoretical law deduced from the theoretical movement of the load and the theoretical swinging thereof.

The movement datum for the mobile support is therefore imposed and the slaving method cannot therefore be used for manual operation and arbitrary movement of the mobile support.

Furthermore, the theoretical law governing the movement of the load has to comply with conditions of continuity and of differentiability which, being associated with the conditions at the extremities of the trajectory, restrict the options for choosing this law (the initial position of the trajectory being from the position which the load is moved and the end of the trajectory being the position to which the load is moved). The known slaving method is therefore not applicable to arbitrary movement laws for the load and for the mobile support.

Finally, the condition under which the sway of the load is null is only required at the end of the trajectory and is not a priority provided for while the load is being moved.

The swing of the load may therefore remain very great as it is being moved.

The object of the present invention is to overcome the aforementioned drawbacks and provide numerous advantages in the field of the movement of suspended loads, particularly using dockside lifting gear.

In particular, it makes it possible to move a hanging load, whilst limiting as far as possible the swinging of this load and also eliminating all restrictions in the movement of the mobile support.

The subject of the invention is a method for controlling the swinging of a hanging load suspended from a mobile support, wherein the movement of the mobile support is driven by any speed datum for said support.

According to the invention, this method is one which comprises a step of slaving the actual value of the sway of the hanging load to a zero sway datum and a step of adjusting the speed datum for the support as a function of a correction value determined during the sway slaving step.

Thus, by virtue of the method of the invention, the speed of the mobile support is continually adjusted to constantly maintain a small amount of swinging of the hanging load.

Slaving the sway makes it possible, when moving this load, to take into account all the effects of damping or deflections which may move this load away from its vertical position.

In addition, the movement of this hanging system does not require a reference model. Only the datum regarding the sway of the load is zero, that is to say that the pendulum formed by the load suspended from the mobile support remains vertical, with neither the support nor the load following a predetermined theoretical movement law.

The method according to the invention therefore makes it possible to control the swinging of the load even for manual operation.

According to an advantageous version of the invention, the control method further comprises a step of reading a manual speed datum for the mobile support, the manual datum being adjusted as a function of the correction value determined during the sway slaving step.

The hanging load can therefore be moved with manual commands actuated by an operator, it being possible for the speed datum given by the operator to be arbitrary and to be adjusted automatically by the method according to the invention so as to ensure zero swinging of the load at the end of its trajectory.

According to another version of the invention, the method comprises a second step of slaving the actual position of the mobile support to a position datum simultaneously with the first step of slaving the sway of the load, the speed datum of the mobile support being adjusted as a function of the correction value determined during the sway slaving step and of a second correction value determined during the second position slaving step.

The position datum for the mobile support may consequently be arbitrary, the method, by virtue of two parallel automatic-control loops, allowing the speed of the mobile support to be adjusted so as to obey the position datum for the support and the zero swinging datum for the load.

According to another aspect of the invention, the device for controlling the swinging of a hanging load suspended from a mobile support for the implementation of the method in accordance with the invention, comprises lifting gear having means for lifting the load and means for moving the mobile support, and control and processing means designed to receive information representing the length of the pendulum, the angle of sway of the hanging load and the actual position of the mobile support originating respectively from length acquisition means, angle acquisition means, and position acquisition means.

According to the invention, this device is one wherein the control and processing means are designed additionally to receive information representing a manual speed datum for the mobile support or a position datum for the mobile support and, in return, to send out an adjusted speed datum for the mobile support addressed to a command/control system, for example a speed-varying facility, for said mobile support.

Other features and advantages of the invention will further emerge in the description below.

In the appended drawings, given by way of non-limiting examples:

First of all, with reference in particular to FIGS. 1 and 4, one embodiment of a device allowing implementation of the method according to the invention will be described.

Figure 1:
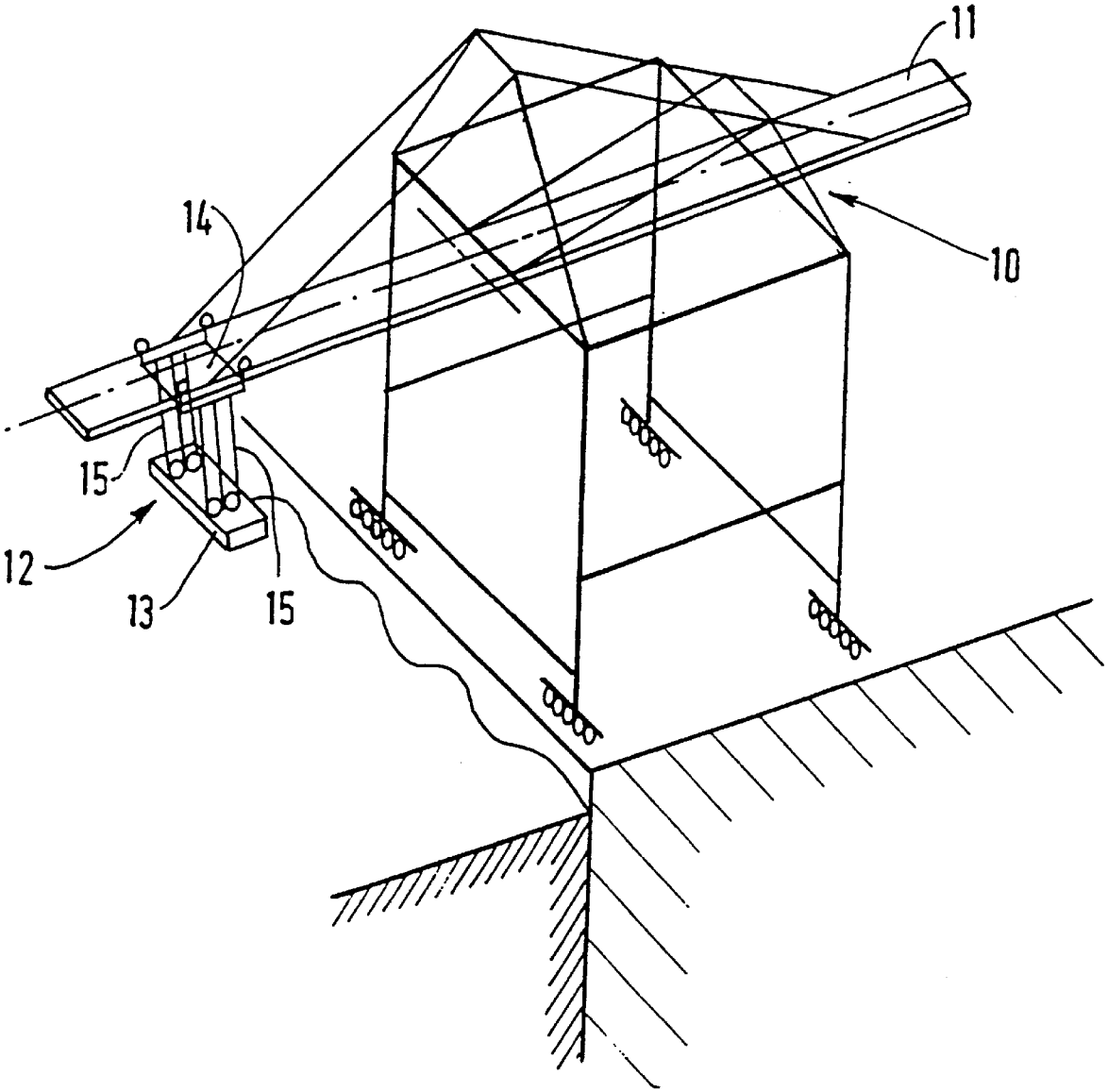
FIG. 1 is an overall view of lifting gear which may be equipped with the device according to the invention.

The object of the device according to the invention is to make it possible to control the swinging of a mobile hanging load 13 as represented in one practical example in FIG. 1.

The loads 13 which are to be moved from one point to another, especially when loading and unloading ships, are generally transported using dockside lifting gear 10 such as cranes or container gantries.

These loads 13 are suspended via cables 15 from a mobile support 14 similar to a trolley 14 designed to move horizontally in a ±x-direction along a rail 11, for example by virtue of rollers running along the rail.

The lifting cables 15 are of a length which may vary by virtue of winches usually stationed on board the mobile trolley 14.

In this way, the load 13 is raised from its starting point, transported beneath the rail 11 then put back down at the end of its trajectory.

While this load 13 is being moved, it may be put through strong oscillations in the ±X-direction.

The main object of the device according to the invention is therefore to control and to avoid this swinging of the suspended load 13 or of the suspended tool 42 which thus constitutes a pendulum 12.

Figure 4:
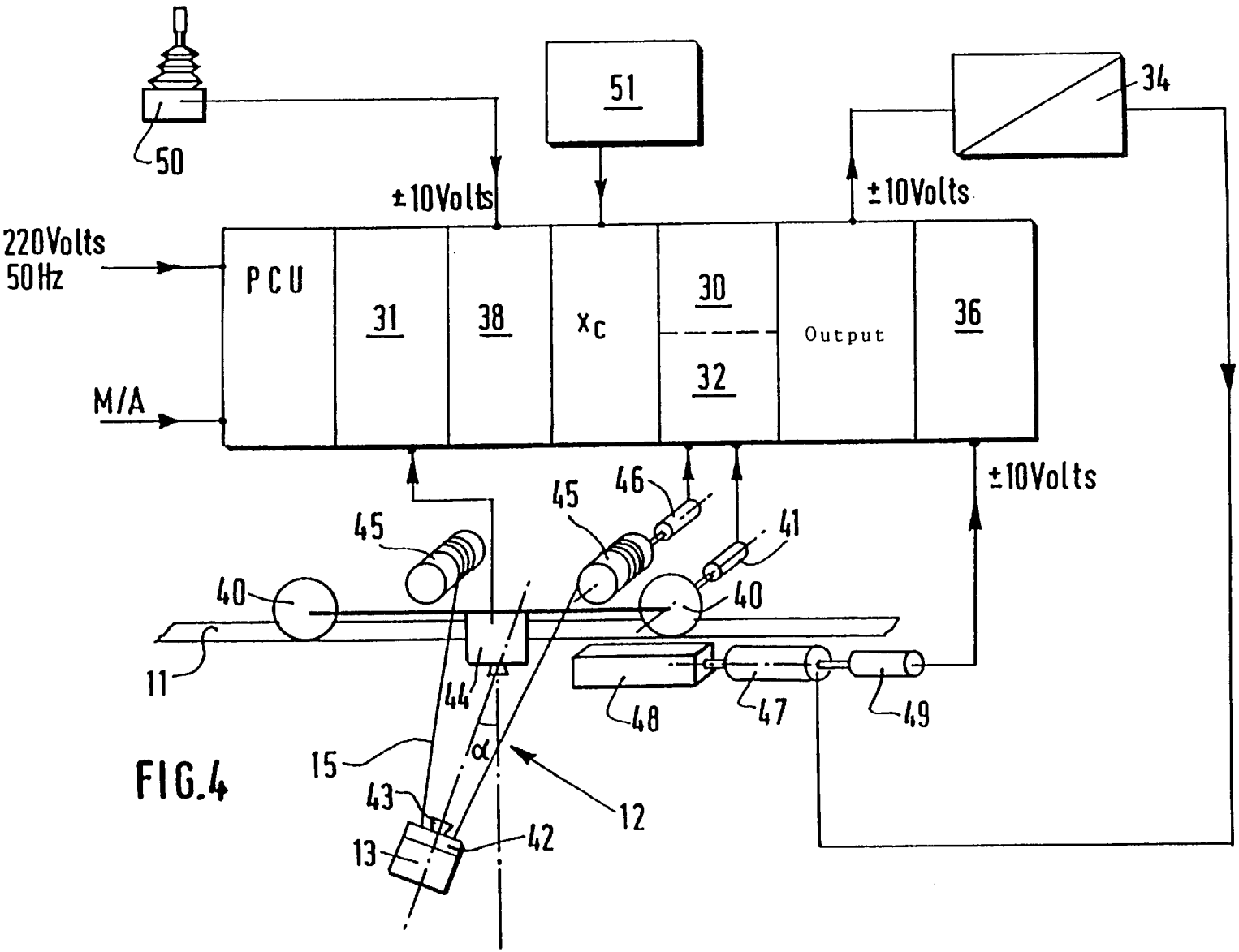
FIG. 4 is a diagrammatic view of one embodiment of a device according to the invention.

As illustrated in FIG. 4, the device comprises lifting gear 45 for the load 13, this gear consisting, in the known manner, of several winches 45 over which the lifting cables 15 may be wound so as to alter the length of the pendulum 12.

The mobile support 14 can move along the horizontal rail 11 by virtue of rollers 40 which can run along the rail 11.

Movement means 48, 47 comprising, in the conventional manner, a motor 47 coupled to reduction gear 48 make it possible to move the support 14 in terms of translation.

The control and processing means CPU proper consist of a central unit in which the control program is stored, which program makes it possible to realize some of the steps of the method according to the invention which will be described later.

The control and processing means CPU are designed to receive information representing the length 1 of the pendulum 12, the angle a of sway of the hanging load 13 and the actual position x of the mobile support 14 along the rail, as well as logic information (for example emergency stop).

Figure 2:
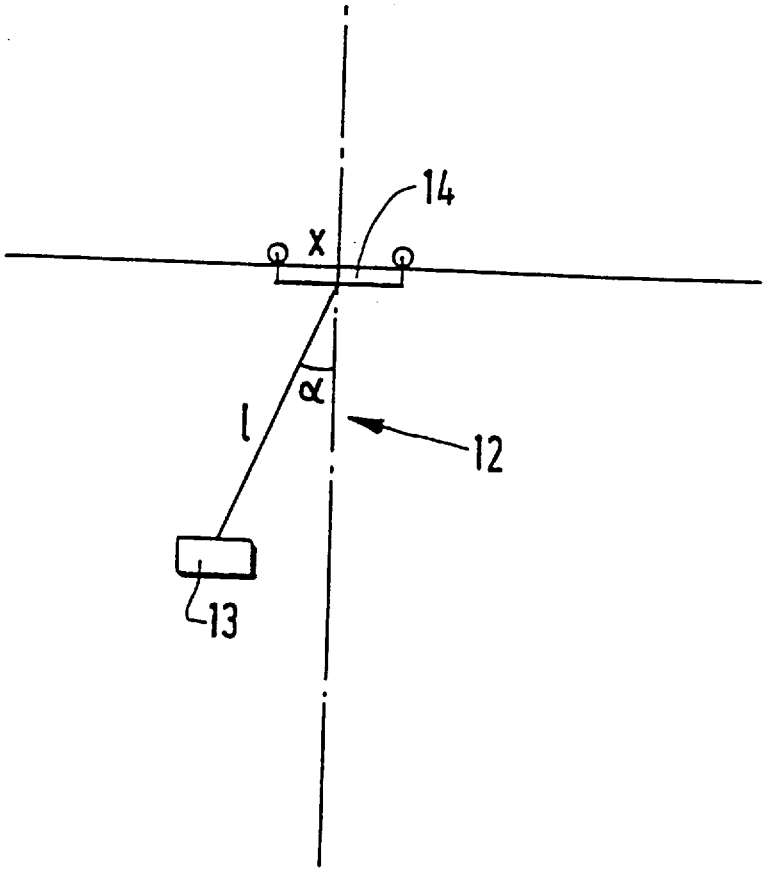
FIG. 2 is a diagram illustrating geometric variables used in the method according to the invention.

These geometric variables l, $\alpha$ and x are illustrated in FIG. 2.

The length 1 corresponds to the distance separating the suspended load 13 from the mobile support 14 and can therefore vary when the length of the lifting cables 15 is altered.

The angle $\alpha$ represents the sway of the load 13 about its vertical axis. The object of the present invention is to keep this angle $\alpha$ small and zero at the end of the trajectory.

The position x of the trolley 14 along the rail 11 varies between the initial position of the trajectory, where the load 13 to be moved is attached, and a final position at which the gear operator wishes to deposit the load 13.

This geometric data 1, $\alpha$ and x is measured using acquisition means, and is then transmitted to the processing means CPU.

The means 46 for acquisition of the length 1 of the pendulum 12 may consist, in the known manner, of a pulse generator mechanically linked to one of the lifting winches 45 on which a variable length of cable 15 is wound.

The means 41 for acquisition of the position x of the mobile trolley 14 may also consist of a pulse generator mechanically linked to one wheel of the trolley and making it possible to keep track of the distance covered by the latter along the rail 11.

The pulses generated, which represent the length 1 and the position x, are transmitted to the processing means CPU at two high-speed count inputs.

The angle $\alpha$ of sway of the load 13 is measured using angle acquisition means 43, 44 which comprise an infrared camera 44 installed on the mobile trolley 14 and directed downward, toward the suspended load 13. An infrared beacon or emitter 43 is placed level with the load 13, for example on the gripping tool, such as a pulley block in the case of container gantries.

This emitter is directed upward so as to send an infrared beam toward the camera 44; the latter being designed to analyze the beam emitted and especially its angle of incidence with respect to the vertical.

The measurement of the angle $\alpha$ is then transmitted to the control and processing means CPU by a serial link. These means are also designed to receive information representing either a manual datum CVM for the speed of the mobile support 14, or a position datum xc for this support 14. In practice, the processing means CPU have separate inputs for the two types of information mentioned above, and are designed to read the information originating from one input or the other.

A command button may be arranged on the lifting gear to allow the operator to select one or other input which is to be taken into account by the processing and control software.

The information relating to the manual speed datum CVM for the trolley 14 is acquired by the control and processing means CPU by virtue of an analog input of the ±10 volts type for example, connected to a combiner 50 commanded manually by the gear operator.

The manual speed datum CVM for the mobile support 14 therefore originates from a manually actuated lever 50 for commanding the movement of the mobile support 14.

The device according to the invention also includes means 51 for the acquisition and memory storage of the position datum xc for the mobile support 14, such as a control desk at which the operator of the lifting gear may program the desired final position of the pendulum 12 as the position datum xc. The latter is then stored in memory in the device so as to be used by the control and processing means CPU.

The latter is designed additionally to send out an adjusted speed datum CV for the mobile support 14 addressed to a command/control system such as a speed varying facility 34 for this mobile support.

The speed datum CV is sent out by virtue of an analog output of the ±10 volts type which allows the command/control system 34 to be driven.

Depending on the speed datum CV transmitted, the command/control system 34 acts on the motor 47 commanding the movement of the mobile support 14 in order to accelerate it or slow it down.

A tachometer 49 makes it possible, at the motor 47, to measure the speed of the latter and to return to the device, via an analog input, a measurement of the speed of the mobile support so as to adjust the operation of the command/ control system 34. This feedback on the actual speed of the support makes it possible to ensure that it is indeed equal to the speed datum CV transmitted to the command/control system 34.

The device also includes a 220-volt 50 Hz power supply and a button M/A of the on/off type allowing the device to be switched on.

Figure 3:
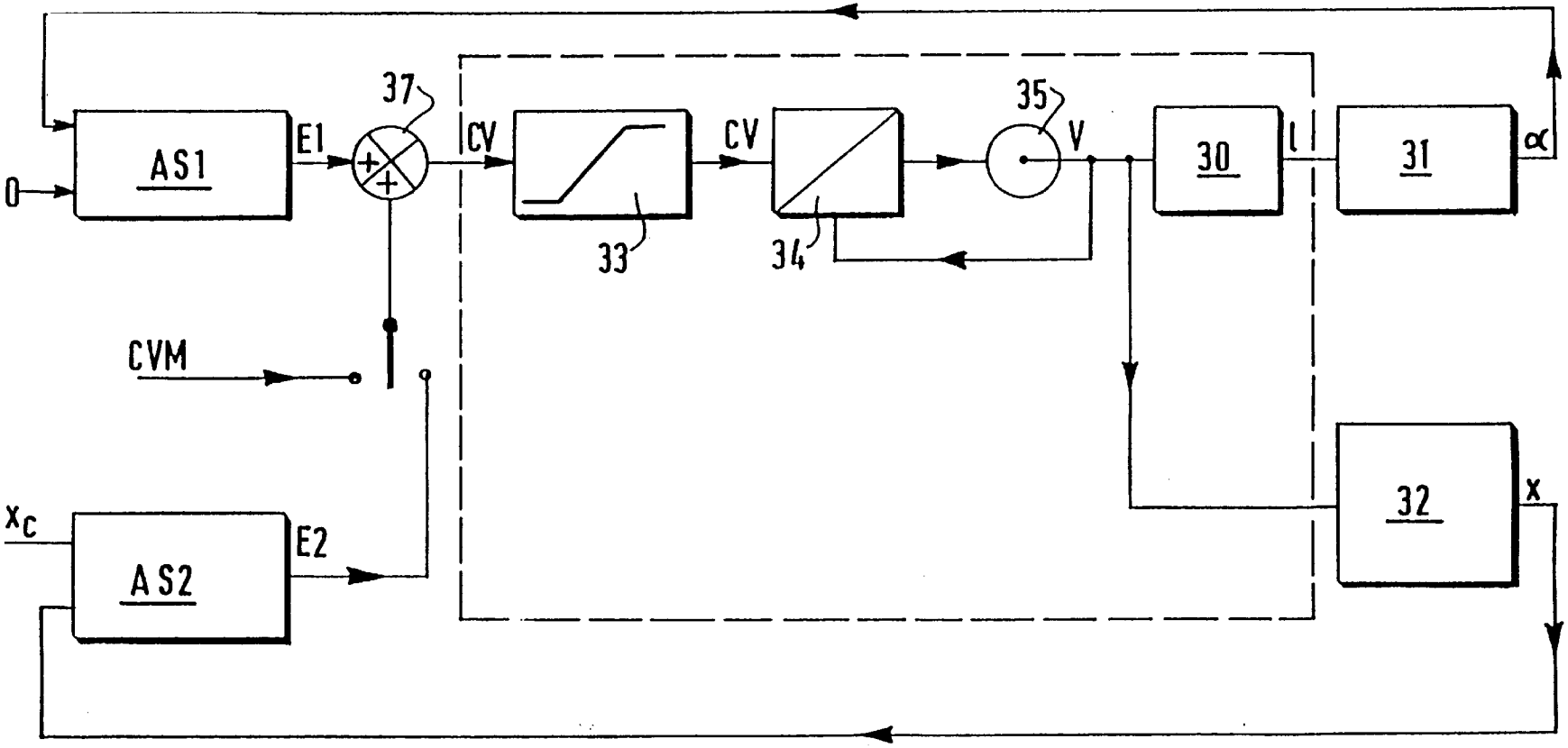
FIG. 3 is a block diagram illustrating the method according to the invention.

The operation of this device will now be described for the implementation of the method according to the invention, with particular reference to FIG. 3.

The method according to the invention controls the swinging of the hanging load 13 suspended from a mobile support 14, the movement of the latter being commanded by a speed datum CV.

The method comprises a step AS1 of slaving the actual value of the sway of the hanging load 13 to a zero sway datum and a step 37 of adjusting the speed datum CV for said support 14 as a function of a correction value E1 determined during the sway slaving step AS1.

The sway slaving step AS1 is a proportional and derivative automatic-control loop.

On the basis of the actual measurement of the sway of the load, that is to say on the basis of a step 31 of acquisition of the angle $\alpha$ of sway and a step 30 of acquisition of the length l of the pendulum 12, and from comparing the measurement of the sway with a zero value (corresponding to an angle $\alpha$ of 0 degrees), a correction value E1 is determined, such that:

$$E_1=K_1\times P(\text{sway})+K_2\times D(\text{sway})$$

where P and D are respectively a proportional function and a derivative function and where $K_1$ and $K_2$ are coefficients determined experimentally, which depend on the mass of the load to be moved, and on the geometry of the pendulum 12.

The correction value E1 is therefore equal to the sum of a first element proportional to the actual value of the sway of the load 13 and of a second element proportional to the derivative with respect to time of the actual value of the sway.

The adjustment step 37 is carried out by virtue of a summer 37 which allows the value of the speed datum CV to be adjusted by adding the calculated correction value E1 to the speed datum.

During manual operation assisted by the method according to the invention, the operator himself commands the speed of the support 14 using the combiner 50.

The method then includes a step 38 of reading the manual speed datum CVM for the mobile support 14.

This manual speed datum CVM is adjusted by the summer 37 as a function of the correction value E1 so as to transmit to the command/control system 34 an adjusted speed datum CV such that CV=CVM+E1.

During automatic operation of the device, the method comprises a second step AS2 of slaving the actual position x of the mobile support 14 to a position datum xc, simultaneously with the first step AS1 of slaving the sway of the load 13.

The position datum xc for the mobile support is preferably equal to a predetermined final position at which it is desired to deposit the load 13.

The actual position x of the mobile support 14 is measured during a step 32 of acquisition of this position by virtue of the acquisition means 41 described earlier.

The position slaving step AS2 is an automatic-control loop of the proportional type during which a second correction value E2 is determined as follows:

$$E2=K_3\ P\ (\Delta x)$$

where P is a proportional function, $\Delta$ x corresponds to the difference between the measured actual position x of the mobile support and the position datum xc, and $K_3$ is an experimental coefficient taking account of the parameters of the method, such as the mass of the load, the geometry of the pendulum, etc.

The speed datum CV for the mobile support is, during this automatic operation, adjusted as a function of the correction value E1 determined during the sway slaving step AS1 and of the second correction value E2 determined during the second position slaving step AS2.

This adjustment is implemented by virtue of the summer 37 so that the speed datum CV is equal to the sum of E1 and E2.

Depending on the choice of operation, manual or automatic, the summer adjusts the speed datum CV taking account either of the manual speed datum CVM given by the operator, or of the correction value E2 determined on the basis of the final position datum xc for the mobile support.

The method further comprises a step 33, upstream of the command/control system 34, of limiting the speed and acceleration of the mobile support 14 to a maximum speed and to a maximum acceleration respectively.

Above and beyond the maximum speed and acceleration values, the speed datum CV is limited so as not to exceed the limiting values imposed.

The speed datum is then addressed to the command/control system 34 which commands the speed of rotation of the motor 47 as already described earlier with reference to the device according to the invention.

A step 35 of adjusting the speed makes it possible continuously to compare the actual speed of the motor 47 and the speed datum CV addressed to the command/control system, and to alter the speed of the motor 47 so as best to comply with the speed datum CV.

This adjusting system makes it possible to damp out the sway forcefully and rapidly irrespective of the trolley speed datum CVM demanded by the operator, even for trolley speeds reaching 3 m/s for example, and this can be done irrespective of the resisting torque and the mass of the load 13 to be moved.

Furthermore, adjustment is effective even if the length l of the pendulum 12 varies while the trolley and the load are being moved.

Slaving on the value of the sway makes it possible to obtain slight swinging of the load throughout the duration of the trajectory, taking the damping which already exists in the device, due to the wind, friction, etc. into account.

Of course the invention is not limited to the embodiments described hereinabove, and many modifications may be made to it without departing from the scope of the invention.

Thus, the means for the acquisition of the angle $\alpha$, the length l or the position x of the trolley, may be any means whatsoever.

We claim:

1. A method for controlling sway of a load suspended from a moving support, comprising the steps of:

directly controlling a speed of movement of the moving support with an arbitrary speed datum;

tracking an actual sway of the load suspended from the moving support;

comparing the actual sway to a zero sway datum;

determining a sway correction value based on the comparison of the actual sway to the zero sway datum; and continually adjusting a speed of movement of the moving support to cause a degree of load sway by correcting the speed datum with the sway correction value to control the speed of the moving support and thus the sway of the load.

2. The method of claim 1, wherein the tracking step further comprises the step of determining a distance the load is suspended from the support, and wherein the comparing step comprises the step of measuring an angle between the load and a vertical axis that is the zero sway datum.

3. The method of claim 1, wherein the determining step comprises the steps of determining a first value proportional to the actual sway, determining a second value proportional to a derivative with respect to time of the actual sway, and combining the first and second values to establish the sway correction value.

4. The method of claim 1, further comprising the step of manually setting the speed datum, and wherein the adjusting step comprises the step of combining the manually set speed datum and the sway correction value to establish a corrected value of the speed datum.

5. The method of claim 1, further comprising the steps of tracking an actual position of the moving support, comparing the actual position of the moving support to a desired position datum, and determining a position correction value based on the comparison, and wherein the adjusting step comprises the step of summing the position correction value and the sway correction value to provide a corrected value of the speed datum.

6. The method of claim 5, wherein the desired position datum is a desired final position of the support when movement of the support has stopped.

7. The method of claim 5, wherein the step of determining the position correction value comprises the step of determining a difference between the actual position and the desired position datum, and wherein the position correction value is proportional to the determined difference between the actual position and the desired position datum.

8. The method of claim 1, further comprising the steps of limiting a speed and acceleration of the moving support to respective maximum values.

9. A device for controlling sway of a load suspended from a movable support, comprising:

means in the movable support for suspending the load a variable distance from the movable support;

means for directly moving the movable support responsive to an arbitrary speed datum;

first means for determining an actual sway angle of the load relative to a vertical axis while the movable support is moving;

second means for determining a distance the load is suspended from the movable support; and processing means for continually determining a sway correction value based on said first and second means, and for continually correcting the speed datum with the sway correction value to control the speed of movement of the support and thus the sway of the load and to cause a degree of load sway.

10. The device of claim 9, further comprising third means for tracking a position of the moving support relative to a desired position datum.

11. The device of claim 10, further comprising means for automatically controlling the speed datum, and wherein said processing means determines a position correction value from said third means, and adjusts the speed datum, and thus the speed of movement of the support, with a sum of the sway and position correction values.

12. The device of claim 9, further comprising means for storing the position datum of the support.

13. A method for controlling sway of a load suspended from a moving support, comprising the steps of:

directly controlling a speed of movement of the moving support with an arbitrary speed datum;

determining a distance the load is suspended from the support;

tracking an actual sway of the load suspended from the moving support;

comparing the actual sway to a zero sway datum by measuring an angle between the load and a vertical axis that is the zero sway datum;

determining a sway correction value based on determined distance of the load and the comparison of the actual sway to the zero sway datum by determining a first value proportional to the actual sway, determining a second value proportional to a derivative with respect to time of the actual sway, and combining the first and second values to establish the sway correction value;

tracking an actual position of the moving support, comparing the actual position of the moving support to a desired position datum, and determining a position correction value based on the comparison; and continually adjusting a speed of movement of the moving support when the speed datum is manually set to cause a degree of load sway by combining the manually set speed datum and the sway correction value to establish a corrected value of the speed datum to control the speed of the moving support and thus the sway of the load, and continually adjusting the speed of movement of the moving support when the speed datum is not manually set to cause a degree of load sway by summing the position correction value and the sway correction value to provide a corrected value of the speed datum.

* * * * *